US008453720B2

(12) United States Patent
Song et al.

(10) Patent No.: US 8,453,720 B2
(45) Date of Patent: Jun. 4, 2013

(54) HEAT EXCHANGER AND CONDENSING TYPE LAUNDRY DRYER HAVING THE SAME

(75) Inventors: Sung-Ho Song, Busan (KR); Jung-Geun Oh, Gyeongsangnam-Do (KR); Sang-Ik Lee, Gyeongsangnam-Do (KR); Yoon-Seob Eom, Gyeongsangnam-Do (KR); Han-Yong Jung, Gyeongsangnam-Do (KR); Sang-Hun Bae, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 1262 days.

(21) Appl. No.: 11/826,355

(22) Filed: Jul. 13, 2007

(65) Prior Publication Data

US 2008/0201977 A1 Aug. 28, 2008

(30) Foreign Application Priority Data

Feb. 23, 2007 (KR) ..... 10-2007-0018682

(51) Int. Cl.
*F28D 1/03* (2006.01)
*F28B 9/08* (2006.01)

(52) U.S. Cl.
USPC ..... 165/153; 165/54; 165/111; 165/909; 165/913; 34/86

(58) Field of Classification Search
USPC ..... 165/134.1, 153, 54, 111, 909, 913; 34/86
See application file for complete search history.

(56) References Cited

U.S. PATENT DOCUMENTS 3,265,126 A * 8/1966 Donaldson ..... 165/153
4,314,607 A * 2/1982 DesChamps ..... 165/166

FOREIGN PATENT DOCUMENTS

| | | | |
|---|---|---|---|
| DE | 3041493 | A * | 6/1982 |
| DE | 30 27 900 | C2 | 11/1986 |
| EP | 1 548 178 | A2 | 6/2005 |
| EP | 1 726 905 | A2 | 11/2006 |
| GB | 2082741 | A * | 3/1982 |
| JP | 2003-114095 | | 4/2003 |

OTHER PUBLICATIONS

German Office Action dated Jul. 20, 2007.
Chinese Office Action dated Jun. 19, 2009.

* cited by examiner

*Primary Examiner* — Leonard R Leo
(74) *Attorney, Agent, or Firm* — Ked & Associates LLP

(57) ABSTRACT

A condensing type dryer uses a heat exchanger in which condensed water can be smoothly discharged through a water-discharging slot formed in a rear end portion of a rear cover of the heat exchanger. The water-discharging slot prevents an air flowing resistance which can be caused by condensed water pooling at the rear end portion of the rear cover. Also, leakage-preventing walls enhance the heat exchanging function by ensuring a uniform flow of cold external air through the heat changer. The leakage-preventing walls prevent external air from leaking around the lateral edges of the heat exchanger.

11 Claims, 4 Drawing Sheets

| HEAT EXCHANGER | TIME | TOTAL(kWh) | E/kg(kWh) | CONDENSING RATE |
|---|---|---|---|---|
| CONVENTIONAL DRYER | 141' 29" | 5.622 | 0.703 | 71.58 |
| ENHANCED DRYER | 137' 14" | 5.526 | 0.691 | 73.38 |

HEAT EXCHANGER AND CONDENSING TYPE LAUNDRY DRYER HAVING THE SAME

The present application claims priority to Korean Application No. 10-2007-0018682, filed on Feb. 23, 2007 which is herein expressly incorporated by reference in its entirety.

BACKGROUND

1. Field

The present invention relates to a heat exchanger for a condensing type clothes or laundry dryer.

2. Background

In general, a drying apparatus such as a clothes dryer or a washing machine having a drying function, dries clothes by blowing hot air generated by a heater into a drum. Such dryers can be divided into exhausting (or vented) type dryers and condensing type dryers, depending on the method used for processing the humid air generated when drying clothes. In the exhausting or vented type dryer, humid air exhausted from a drum is discharged to the outside of the dryer. In the condensing type dryer, humid air discharged from the drum is condensed to remove the moisture therefrom, and the dried air is conducted back into the drum again so as to be re-circulated.

A condensing type dryer typically includes a drum for containing laundry, a filter for filtering out lint and foreign materials, and a heat exchange unit (or condenser) for removing moisture from hot drying air which has flowed through the drum and absorbed moisture from the laundry therein. The dryer also includes a fan for facilitating the drying operation by generating air flow, a heater for heating the air flow to shorten the drying time, and pipes or vents for connecting the components.

FIG. 1 is a side view schematically showing the internal components of an example of a condensing type dryer. FIG. 2 is an interior plan view of the condensing type dryer of FIG. 1. FIG. 3 is a perspective view of a heat exchanger in the dryer of FIG. 1, and FIG. 4 is a lateral side view of the heat exchanger of FIG. 3. The arrows I indicate a flow of external cold air, and the arrows II indicate a flow of circulating hot air.

Referring to FIGS. 1 and 2, a drum 11 in which laundry is to be accommodated is rotatably installed inside a main body 10 which is provided with a door 12 installed at a front surface thereof. The drum 11 is rotated by a belt 19 connected to a motor 17 installed at a lower portion of the main body 10. A heat exchanger (or condenser) 13 is installed at a lower portion of the main body 10 and condenses moisture from hot and humid air that has been circulated through the drum 11 to remove the moisture from the air. Circulation ducts 14*a* and 14*b* which are respectively connected with the front and rear end of the drum 11 are connected with the front and the rear portions of the heat exchanger 13, respectively. When air is discharged from the drum 11, it can be introduced again into the drum 11 after passing through the heat exchanger 13.

A heater 15 for heating air which has passed through the heat exchanger 13 and a circulation fan 16 for forcibly circulating the air through the circulation ducts 14*a* and 14*b* are installed at the circulation duct 14*a*. The circulation fan 16 is connected with a different shaft of the motor 17 that also drives the drum 11.

In order to condense moisture from air circulated through the circulation duct 14*a*, a heat exchanging operation is conducted using external cold air supplied to the heat exchanger 13. For this purpose, an external air supply duct 18 which communicated with the exterior of the main body 10 is connected with one side of the heat exchanger 13. A cooling fan 20 forcibly sucks in external air through the external air supply duct 18 and discharges it into the main body 10. A cooling fan driving motor 21 drives the cooling fan 20. A filter 22 is used to filter out foreign materials such as lint and waste thread or the like from the air exhausted to the circulation duct 14*a* through the front end side of the drum 11.

A water receiver (not shown) for collecting the water condensed during the condensation process is installed below the heat exchanger 13. A pump 23 is used to pump the condensed water collected in the water receiver to a condensed water storage tank 2.

Referring to FIG. 3, the external air passes through the lateral side surfaces of the heat exchanger 13 in the direction of the arrows I, and the circulating air passes through the front and rear ends of the heat exchanger 13 in the direction of the arrows II. Through this process, heat exchange occurs in the heat exchanger 13 between the external air and the circulating air. The circulating air is cooled, which causes moisture in the circulating air to condense and thereby be removed from the drum 11. The cooled and dried circulating air is then heated and blown into the drum 11 again so as to be re-circulated.

When moisture is condensed in the heat exchanger, it flows to the exposed lower end portion of the heat exchanger 13. The condensed water collects at the lower end portion of the heat exchanger 13 (the part shown encircled by the dashed line in FIG. 3), which causes an airflow resistance, and the performance of the heat exchanger 13 is deteriorated. Also, due to the obstruction caused by the pooled condensed water, the flow of the external cold air is forced towards the lateral edge regions of the heat exchanger 13, as shown within the dashed lines in FIG. 4. As a result, it is difficult to ensure a uniform distribution of the external air flow. As a result, a drying performance of the dryer may become deteriorated.

BRIEF DESCRIPTION OF THE DRAWINGS

The embodiments will be described in detail with reference to the following drawings, in which like reference numerals refer to like elements, and wherein.

DETAILED DESCRIPTION

Figure 1:
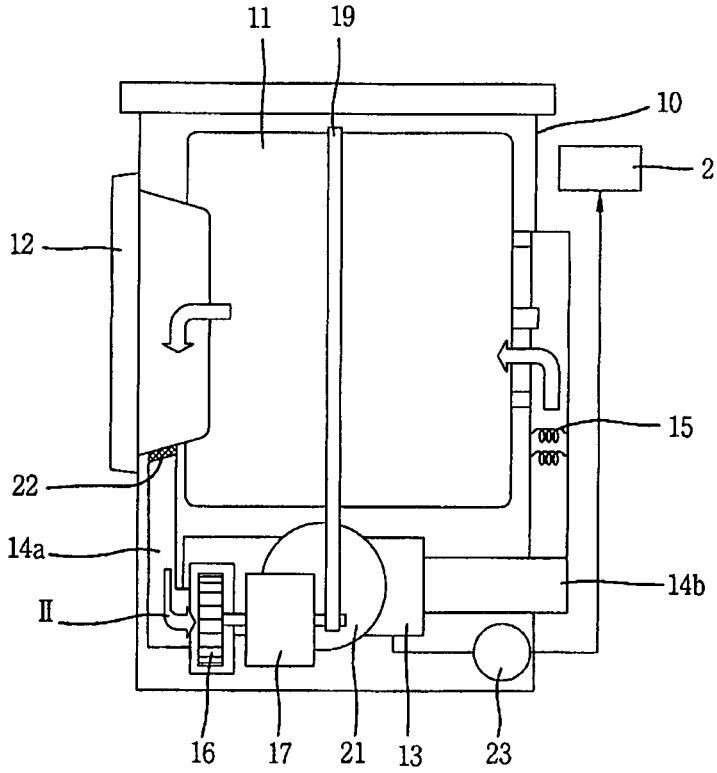
FIG. 1 BACKGROUND ART
FIG. 1 is a view schematically showing the interior of a condensing type dryer.
Figure 2:
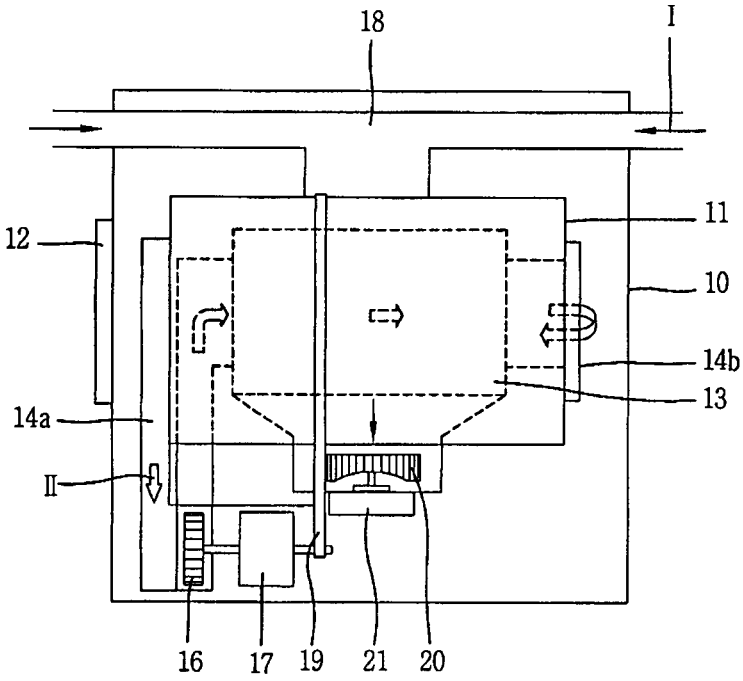
FIG. 2 BACKGROUND ART
FIG. 2 is a plan view of the interior of the condensing type dryer in FIG. 1.
Figure 3:
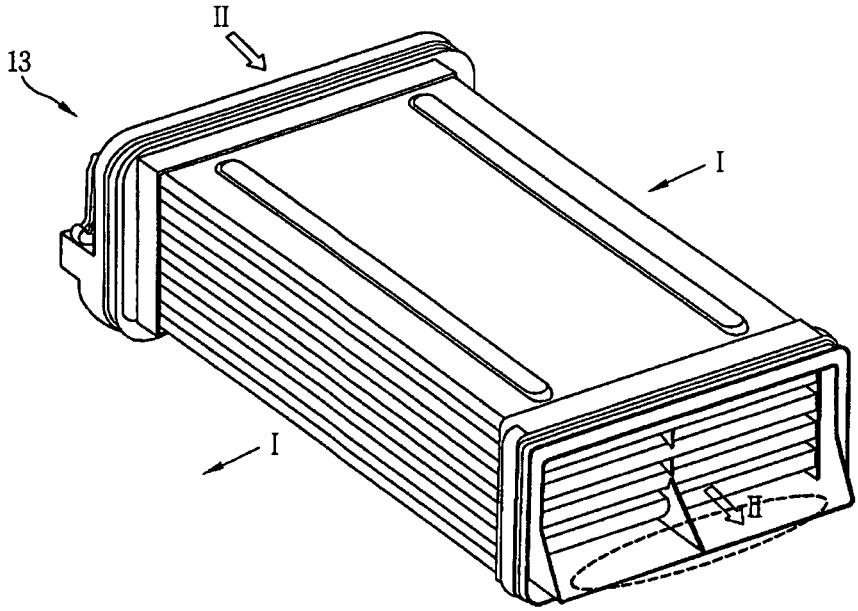
FIG. 3 BACKGROUND ART
FIG. 3 is a perspective view of a related art heat exchanger which can be used in a condensing type dryer.
Figure 4:
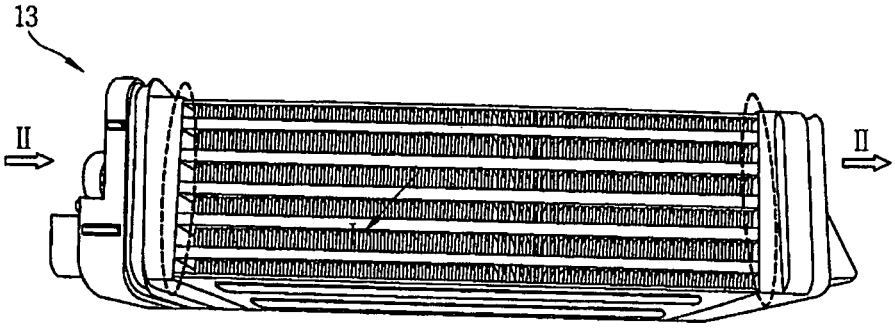
FIG. 4 BACKGROUND ART
FIG. 4 is a side view showing a lateral surface of the heat exchanger in FIG. 3.
Figure 5:
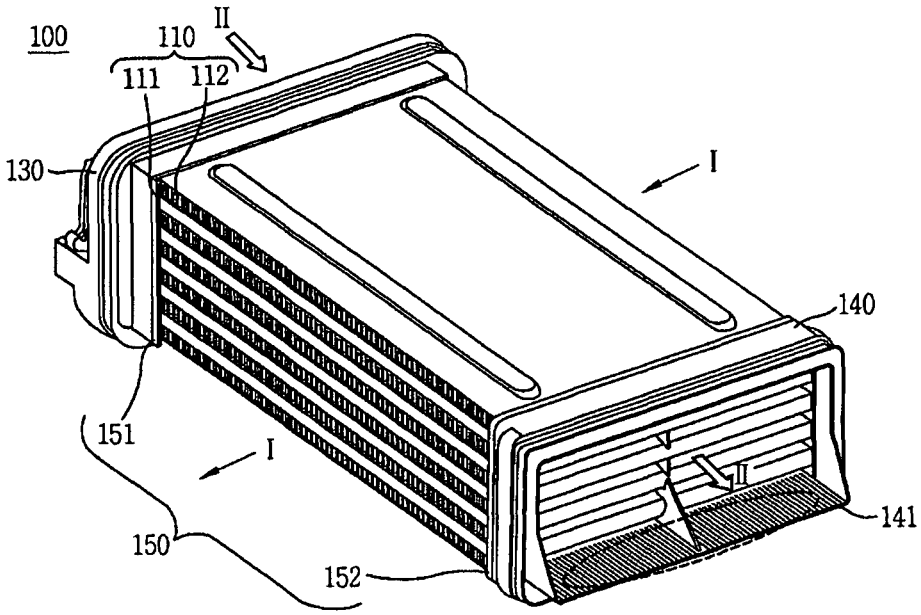
FIG. 5 is a perspective view of a first embodiment of a heat exchanger having improved water flow characteristics which can be used in a condensing type dryer.

Referring to FIG. 5, a first embodiment of a heat exchanger 100 includes a heat exchange unit 110 in which a plurality of tubes 111 and fin structures 112 are alternately stacked. A front cover 130 covers a front end of the heat exchange unit 110, and a rear cover 140 covers a rear end of the heat exchange unit 110. Leakage-preventing walls 150 are installed at lateral edges of the heat exchange unit 110.

Both ends of the tubes 111 may be opened and the tubes 111 may have a duct structure with a rectangular cross-sectional shape. Ducts or pipes (not shown), through which circulating air in the dryer flows, communicate with both ends of the tubes 111, respectively.

The fin structures 112 may be formed with air passages by the repeated bending of a metal plate in a zigzag pattern. For example, the fin structures 112 may be bent in the zigzag pattern to form a rectangular parallelepiped structure having a fixed thickness, width and length at its exterior. If the metal plate is bent in a zigzag pattern, it may be formed into a repeated peak-and-valley structure. The upper and lower sides of the fin structure may be placed in contact with the surfaces of adjacent tubes 111, respectively, and the fin structures can be joined to the tubes. The fin structures provide passages for the external air to be introduced into the heat exchanger and to be discharged again after undergoing a heat exchanging operation with air in the tubes 111.

The thickness of the fin structures 112 is based upon the sizes of the tubes 111 stacked thereon, and possibly based on the number of tube and fin structures that are stacked together. Preferably, the thickness of the fin structures is in the range of 8-10 mm. It is preferable that the tubes are thinner than the fin structures in order to increase the heat transfer rate. The tubes 111 and the fin structures 112 are made of a metal material with excellent heat transfer characteristics, and preferably are made of aluminum or an aluminum alloy.

The front cover 130 and rear cover 140 may be coupled with the front and rear surfaces of the heat exchange unit 110, respectively. The front and rear covers 130, 140 may perform a coupling means function to allow the inlet and outlet of heat exchange unit 110 to be easily coupled with the communicating ducts or pipes in the dryer or with other components.

The front and rear covers 130, 140 may be made of a plastic material such as ABS-GF. They would typically be formed by a method such as injection molding. A sealing member or gasket may be additionally installed at the portions where the front and rear covers 130, 140 are coupled at both ends of the heat exchange unit 110 in order to prevent the leakage of air.

Figure 6:
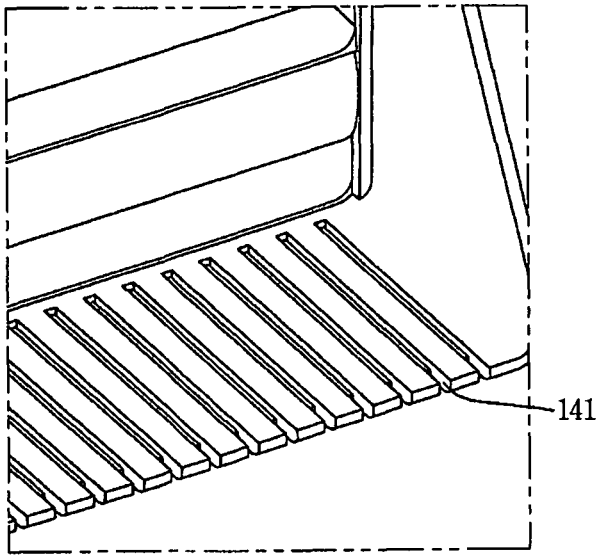
FIG. 6 is a magnified partial view showing water-discharging slots formed in a lower end portion of a rear cover of the heat exchanger in FIG. 5.

Referring to FIGS. 5 and 6, one or more water-discharging slots 141 may be formed in the lower end portion of the rear cover 140 (dashed-line oval portion in FIG. 5). A plurality of the water-discharging slots 141 may be formed side-by-side, with the slots extending in the lengthwise direction of the lower end portion or bottom lip of the rear cover 140. Condensed water can be smoothly drained and discharged through these water-discharging slots 141. This prevents the condensed water from deteriorating the performance of the dryer due to the generation of an air flowing resistance caused by the pooling of collected condensed water at the rear end portion of the rear cover 140.

Figures 7, 8:
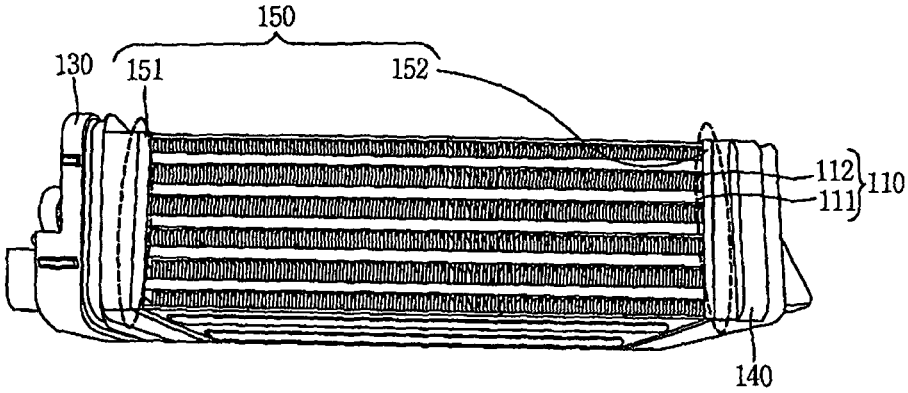
FIG. 7 is a side view showing a lateral side of the heat exchanger in FIG. 5 provided with leakage-preventing walls.
FIG. 8 is a table comparing the performance of the heat exchanger in FIG. 5 with that of a conventional heat exchanger.

Referring to FIG. 7, leakage-preventing walls 150 may include a first leakage-preventing wall 151 formed at the front cover 130 and covering the front lateral edges of the heat exchange unit 110 (dashed-line oval portion in FIG. 7); and a second leakage-preventing wall 152 formed at the rear cover 140 and covering the rear lateral edges of the heat exchange unit 110. The first leakage-preventing wall 151 and the second leakage-preventing wall 152 can be integrally formed with the front and rear covers by extending the lateral ends of the front and rear covers 130, 140 in the lateral direction of the heat exchange unit 110, respectively. Alternatively, the first leakage-preventing wall 151 and the second leakage-preventing wall 152 can be separate additional members that are welded or bonded to the lateral ends of the front and rear covers 130, 140 in the lateral direction of the heat exchange unit 110, respectively. The leakage-preventing walls 150 enhance the heat exchanging function as the external air can be forced to flow uniformly through the fin units. The leakage-preventing walls prevent the cold external air from flowing around the ends of the fin structures at the front and rear sides of the heat exchanger 100.

FIG. 8 is a table comparing the performance of a heat exchanger as shown in FIGS. 5-7 with that of a conventional heat exchanger. Referring to FIG. 8, a condensation type dryer having a heat exchanger as described above had a drying time that was approximately 4 minutes faster, a reduced power consumption of 0.012 kWh less per 1 kg, and a condensing rate approximately 2% higher than the conventional dryer. Thus, the above-described heat exchanger is excellent in its condensing rate compared to a conventional heat exchanger. When the heat exchanger is employed in a condensing type dryer, the power consumption and the drying function of the dryer can be enhanced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, variations and modifications are possible in the component parts and/or arrangements which would fall within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a heat exchange device in which a plurality of tubes and a plurality of fin structures are alternately stacked, wherein air to be cooled and condensed enters the plurality of tubes at a front end of the heat exchange device and exits the plurality of tubes through a rear end of the heat exchange device, and wherein air used to cool the air in the plurality of tubes passes through the plurality of fin structures and enters and exits at lateral sides of the heat exchange device;

a rear cover that covers the rear end of the heat exchange device; and a plurality of longitudinal water-discharging grooves formed side-by-side, wherein the plurality of longitudinal water-discharging grooves extends in a lengthwise direction of a lower end portion or a bottom lip of the rear cover, wherein each of the plurality of longitudinal water-discharging grooves is formed on the lower portion or the bottom lip of the rear cover, extends in a direction that is substantially parallel to a direction of air flow exiting the plurality of tubes, is formed in a shape of a longitudinally outward extended groove, and functions as a flow passage of condensed water to be drained, and wherein each of the plurality of longitudinal water-discharging grooves comprises a slot at a rear end portion thereof that prevents a flow resistance to the discharged condensed water by dew formed at the rear end portion of the respective longitudinal water-discharging groove.

2. The heat exchanger of claim 1, further comprising first and second leakage-preventing walls installed at the lateral sides of the heat exchange device adjacent the front and rear ends of the heat exchange device.

3. The heat exchanger of claim 2, further comprising:

a front cover mounted on the front end of the heat exchange device, wherein the first leakage preventing wall is coupled to the front cover; and the rear cover mounted on the rear end of the heat exchange device, wherein the second leakage-preventing wall is coupled to the rear cover.

4. The heat exchanger of claim 3, wherein the first leakage-preventing wall is an extension of the front cover, and wherein the second leakage-preventing wall is an extension of the rear cover.

5. The heat exchanger of claim 3, wherein the front and rear covers are made of a plastic material.

6. The heat exchanger of claim 3, further comprising a sealing member or gasket installed at portions where the front and rear covers are coupled to the heat exchange device.

7. A condensing type laundry dryer comprising the heat exchanger of claim 1.

8. The heat exchanger of claim 1, wherein the plurality of tubes are thinner than the plurality of fin structures.

9. The heat exchanger of claim 8, wherein a thickness of the plurality of fin structures is in a range of 8-10 mm.

10. The heat exchanger of claim 1, wherein the plurality of tubes and the plurality of fin structures are made of a metal material.

11. The heat exchanger of claim 10, wherein the plurality of tubes and the plurality of fin structures are made of aluminum or an aluminum alloy.

* * * * *